United States Patent [19]

Shetler, Sr.

[11] 4,304,526

[45] Dec. 8, 1981

[54] WELL SYSTEM AND FLOW CONTROL TANK

[76] Inventor: Earl B. Shetler, Sr., 9508 Tuscola Rd., Clio, Mich. 48420

[21] Appl. No.: 40,076

[22] Filed: May 17, 1979

Related U.S. Application Data

[63] Continuation-in-part of Ser. No. 850,596, Nov. 11, 1977, abandoned, which is a continuation of Ser. No. 664,380, Mar. 5, 1976, abandoned, which is a continuation-in-part of Ser. No. 569,220, Apr. 18, 1975, abandoned.

[51] Int. Cl.[3] ..... F04B 49/06

[52] U.S. Cl. ..... 417/38; 417/83

[58] Field of Search ..... 417/19, 38, 44, 82, 417/83; 138/30; 137/568, 855

[56] References Cited

U.S. PATENT DOCUMENTS

| | | | |
|---|---|---|---|
| 2,412,107 | 12/1946 | Tannehill | 417/44 |
| 2,533,428 | 12/1950 | Carpenter | 417/83 |
| 2,660,953 | 12/1953 | Tinker et al. | 417/82 |
| 3,126,029 | 3/1964 | Englesson | 137/855 |
| 3,482,598 | 12/1969 | Bencic | 137/568 |
| 3,537,357 | 11/1970 | Archer | 138/30 |
| 3,593,744 | 7/1971 | Smith | 138/30 |
| 3,625,256 | 12/1971 | Smith | 417/38 |
| 3,868,972 | 3/1975 | Zirps | 138/30 |
| 3,876,336 | 4/1975 | Nash | 417/38 |
| 4,124,331 | 11/1978 | Taki | 417/19 |

*Primary Examiner*—Leonard D. Christian
*Attorney, Agent, or Firm*—Barnes, Kisselle, Raisch & Choate

[57] ABSTRACT

A well system comprising a pump having an inlet and an outlet and a combined pressure regulating valve and pressure flow control tank. The tank comprises a hollow container having a diaphragm therein overlying an inlet connected to the outlet of the pump and an outlet connected to the system. The diaphragm is urged by a charge of gas in the container to normally seal the inlet and outlet to said chamber in the absence of fluid pressure from the pump sufficient to move the diaphragm away from the inlet and outlet. Thus, the combined pressure regulator valve and pressure tank functions as a flow control to insure that the flow from the outlet is substantially at a predetermined pressure and that when the pressure falls below a predetermined amount, the diaphragm seals against said inlet and the outlet to said chamber and maintains water in the outlet of the pump sufficient to maintain a prime on the pump and prevent the pump from running dry.

The flow control tank is further combined as a well yield control in a low-yield well system including a downstream water storage tank and associated pump motor control pressure switch so as to protect the pump by matching the yield of the well to the capacity of the pump. The flow control tank is also combined with a water storage tank to apportion the water supply from the water system to at least two separate water distribution systems to thereby assure that water supply to one distribution system has priority over the supply to the other, or vice versa, as desired. A plurality of the flow control tanks are also combined as back flow control valves to prevent water source contamination in the event of abnormally low pressures developing in the water supply system. The tank is also employed in a system for supplying liquid, such as fuel oil, to a battery of oil burners or the like, which are individually connectable to or disconnectable from the supply line, so as to automatically control the supply of the liquid at a uniform pressure to the burners.

20 Claims, 13 Drawing Figures

WELL SYSTEM AND FLOW CONTROL TANK

This application is a continuation-in-part of co-pending application Ser. No. 850,596, filed Nov. 11, 1977 now abandoned, which in turn is a continuation of application Ser. No. 664,380, filed Mar. 5, 1976, now abandoned, which in turn is a continuation-in-part of application Ser. No. 569,220, filed Apr. 18, 1975, now abandoned.

This invention relates to well systems and other pressurized liquid distribution systems, and to a flow control tank used therein.

BACKGROUND OF THE INVENTION

In well systems, a common problem is the maintaining of a prime on the pump to insure the start up of the pump system and to prevent the pump from running dry. It has been common to utilize some type of pressure device to attempt to assist in maintaining such head for prime.

In jet pump systems for deep wells, a jet assembly comprising two pipes is placed in the well and is associated with the pump, one pipe comprising the pump inlet and the other taking a portion of the pump outlet and recirculating it through the jet assembly. In such systems it is common to utilize a manual, semi-automatic pressure operated control valve to maintain the pressure of the return water to the pump to compensate for varying well depths. Such devices are not only difficult to adjust but are a source of malfunction due to encrustation of the working parts. As a result replacement and repair of such parts is very often necessary.

Another problem with well systems is that associated in the encrustation of pressure gauges and pressure switches associated with the system. For example, a pressure gauge associated with a pump or tank may initially have air entrapped therein but, in time, the air becomes absorbed in the water and the water contacts the parts thereof. The resulting encrustation not only causes damage but also erratic behavior.

Among the objects of the invention are to provide a system wherein pump prime is insured, wherein the use of a manual, semi-automatic or automatic pressure operated control valve is obviated, and wherein these functions are achieved at minimum cost and with a flow control tank device that requires minimum maintenance.

Further objects are to provide improved water or other pressurized liquid distribution systems wherein one or more of the foregoing objects and advantages are achieved utilizing the flow control tank of the invention in various system configurations, such as in a low-yield well system to protect the pump by matching the yield of the well to the capacity of the pump, in a plural output delivery system to insure priority of supply to one output relative to another, in a municipally supplied water system or the like having plural branch outputs at differing elevations to prevent water source contamination in the event of abnormally low primary source pressure fluctuations, and in a pressurized liquid distribution system wherein one pump is connected to supply a plurality of outputs adapted to be individually connected to the pump supply to thereby furnish liquid to one or more of the outputs at a constant pressure.

Other objects, as well as features and advantages of the invention, will become apparent from the following detailed description and accompanying drawings, as well as from the claims appended hereto.

SUMMARY OF THE INVENTION

In accordance with the invention, a combined pressure regulator valve and pressure tank is provided as a flow control in the system. The combined pressure regulated valve and pressure tank includes a container or housing with a diaphragm that is urged by a compressible gas at a predetermined pressure to normally close an inlet connected to the pump outlet and an outlet extending to the system. In operation the water from the pump forces the diaphragm upwardly against the pressure of the compressible gas and through the outlet to the system. When the pressure from the pump falls below a predetermined value and the pump operation is stopped, the diaphragm seals both the inlet and outlet, isolating the water from the system from the water from the pump, maintaining a prime on the pump and preventing the pump from running dry. Further in accordance with the invention, a pressure switch is associated with a first chamber and functions to control the operation of the motor.

DESCRIPTION

Figure 1:
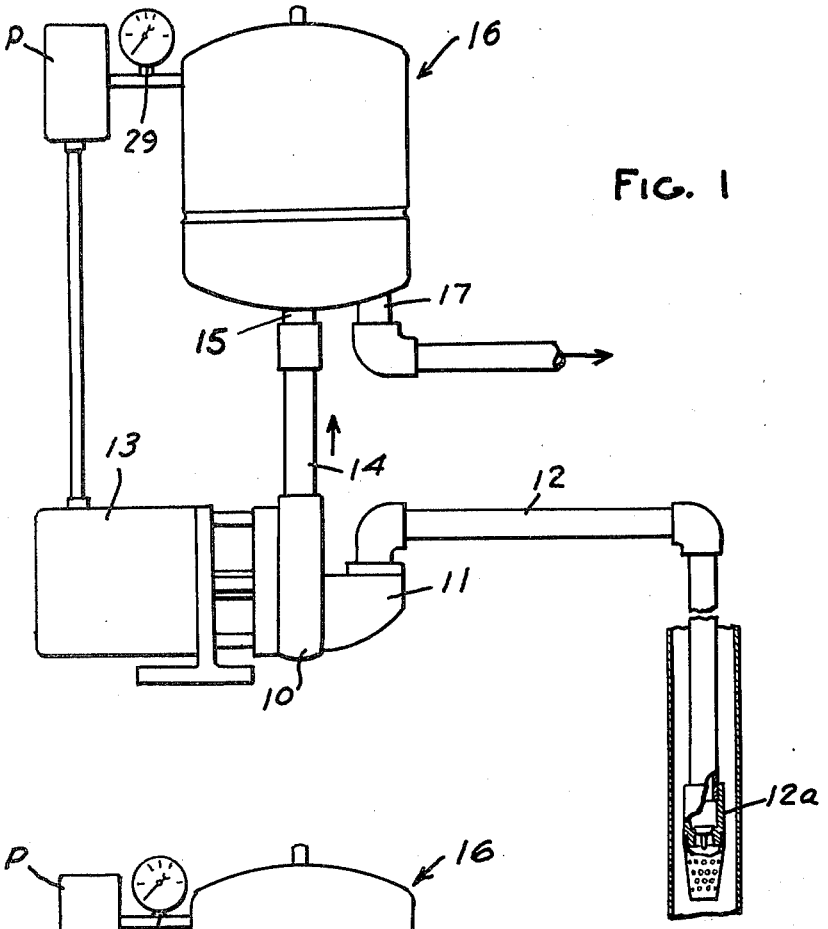
FIG. 1 is a fragmentary partly diagrammatic view of a system embodying the invention.

Referring to FIG. 1, the invention is described in association with a shallow well jet system comprising a pump 10 which is connected through a jet pump assembly 11 and an inlet pipe 12 to a front valve **12*a*** of the well. The pump 10 is driven by a motor 13 and has one or more stages for directing water to an outlet 14. The outlet 14 passes to an inlet 15 of a combined pressure regulator and pressure tank 16. The tank 16 includes an outlet 17 passing to the system.

Figure 3:
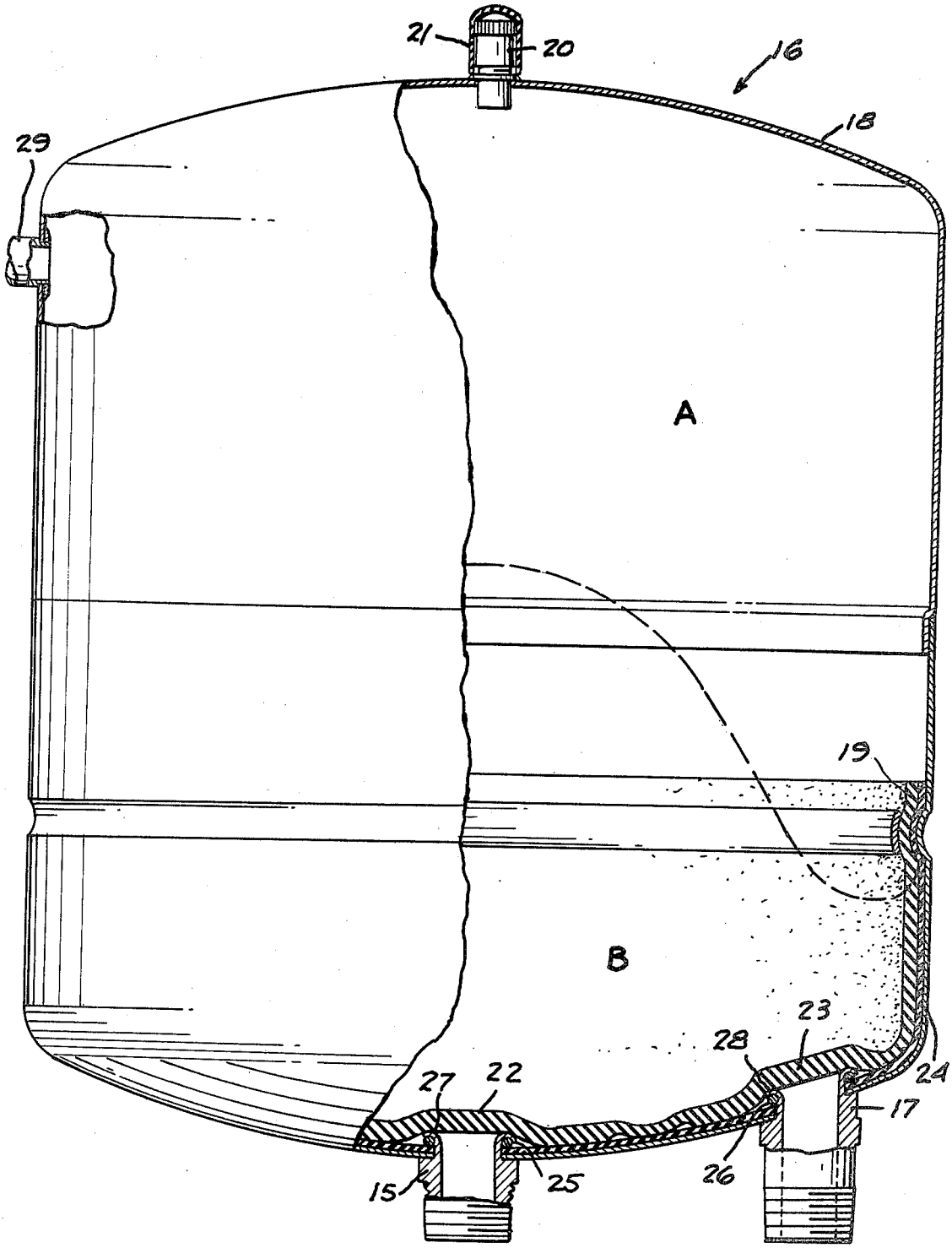
FIG. 3 is a part sectional view of a combined pressure regulator and pressure tank utilized in the system.

Referring to FIG. 3, the combined pressure regulator and pressure tank 16 comprises a hollow sheet metal housing or container 18 that is made of two halves. A diaphragm 19 of flexible material is provided on the lower portion of the container 18. The portion above the diaphragm 19 defines a first chamber A which is filled with a compressible gas such as air through a one-way valve 20 over which a cap 21 is positioned. When water is flowing through inlet 15 and out of outlet 17, the diaphragm 19 is in intermediate position such as the broken line position so that in effect the diaphragm divides the container into two chambers A and B that vary in volume. The diaphragm 19 conforms in the position shown in FIG. 3 with the interior of the container 18 and has thickened portions 22, 23 overlying the inlet and outlet 15, 17 respectively.

The combined pressure regulator and pressure tank is preferably made by modifying an expansion tank such as shown in the U.S. Pat. No. 3,524,475 to C. H. Kirk, Jr. issued Aug. 18, 1970 and includes a plastic liner 24 that has the same configuration as the lower internal surface of the container 18, which liner protects the water from contact with the interior of the container. The portion of the liner surrounding the inlet 15 and outlet 17 is clamped by means of the fittings forming the inlet 15 and outlet 17 and more particularly by an O-ring 25, 26 which is made of rubber or the like and compressed between a lip 27, 28 on the upper end of the fitting.

Referring to FIG. 1, a line 29 extends from the upper chamber A to a pressure gauge and pressure switch P, the latter controlling the motor 13.

Figure 4:
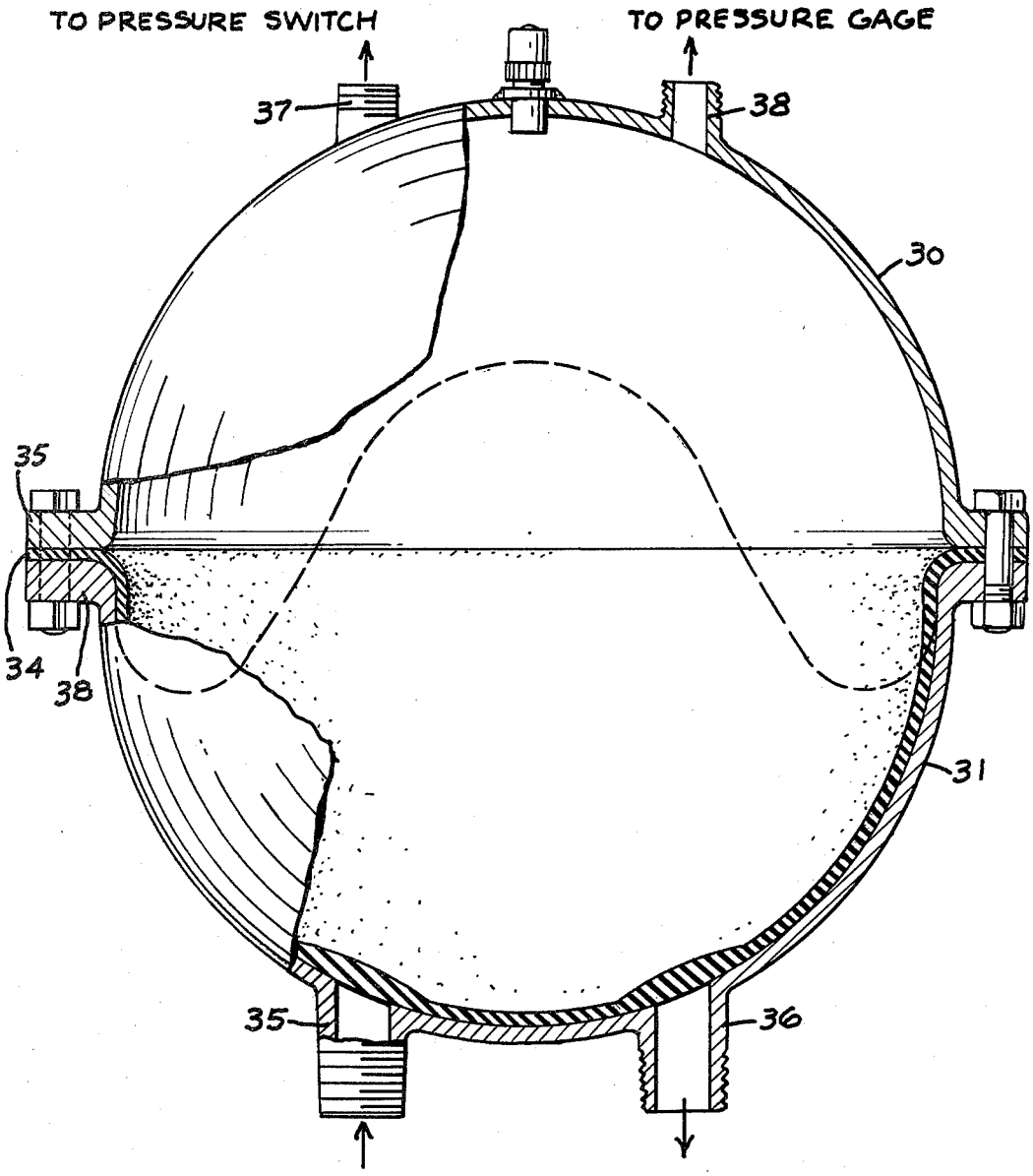
FIG. 4 is a part sectional view of a modified form of combined pressure regulator and pressure tank utilized in the system.

Alternatively the combined pressure regulator and pressure tank may comprise two formed halves 30, 31 as shown in FIG. 4 which have flanges 32, 33 between which the diaphragm 34 is clamped. As shown in FIG. 4, integral pipes 35, 36 form the inlet and outlet respectively. In this form, integral fitments 37, 38 are provided for connecting of a pressure switch and pressure gauge respectively.

Figure 5:
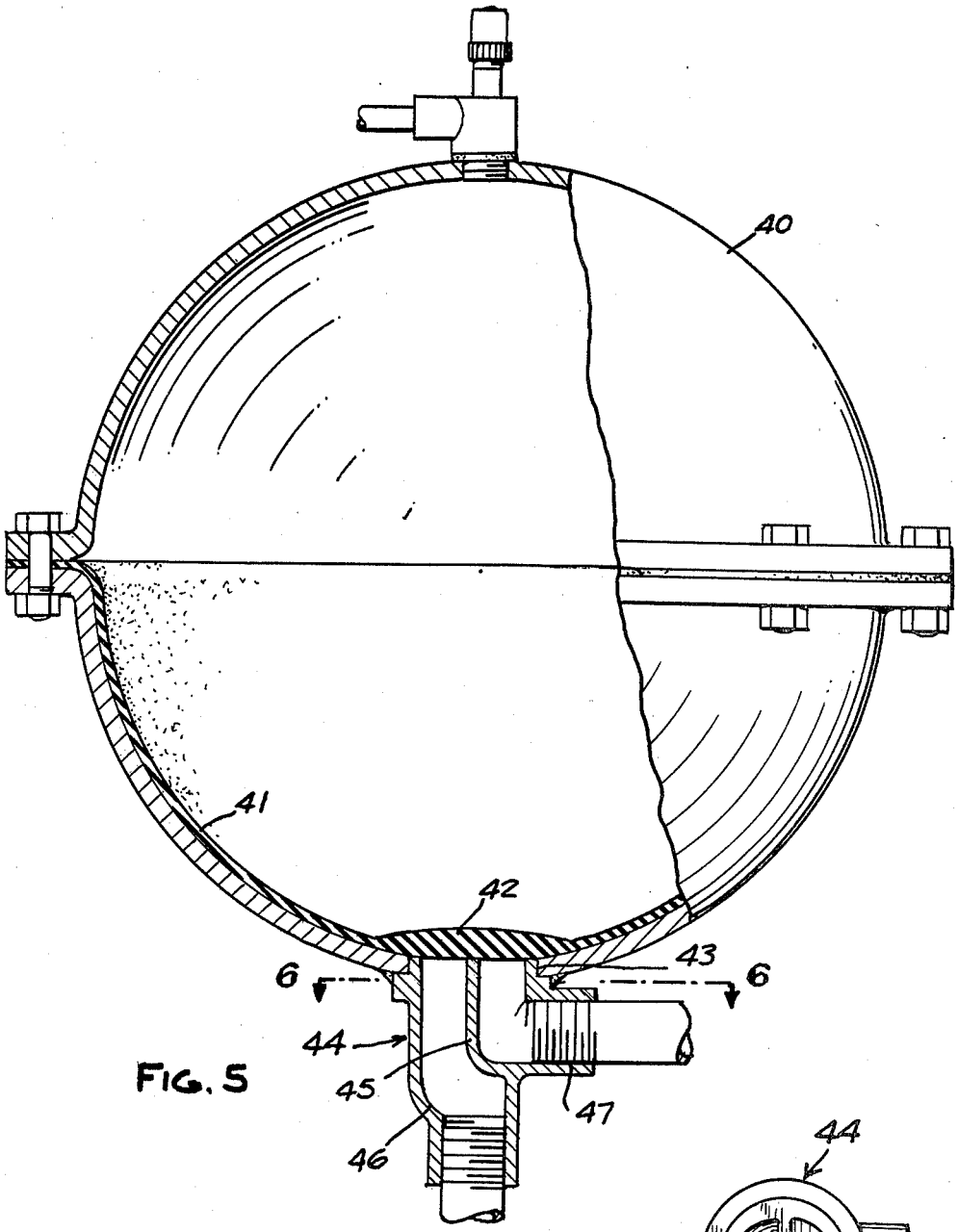
FIG. 5 is a part sectional view of a further modified form of the invention.
Figure 7:
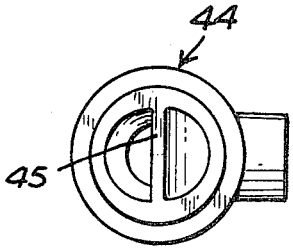
FIG. 7 is a plan view of a part of the apparatus shown in FIG. 5.
Figure 6:
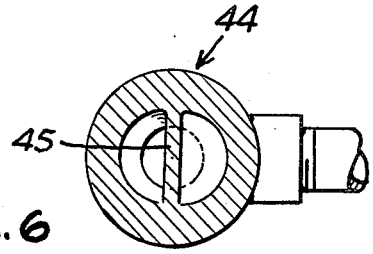
FIG. 6 is a sectional view taken along the line 6—6 in FIG. 5.

In the form of the invention shown in FIGS. 5–7, the combined pressure regulator and pressure tank comprises a tank or container 40 and a diaphragm 41 which in the untensioned state extends along the one wall of the tank 40 and has a central thickened portion 42 overlying an opening 43. A fitting 44 is mounted in the opening 43 and provides a combined inlet and outlet. The fitting 44 includes a central wall 45 so that an inlet 46 is formed on one side and an outlet 47 on the other side. The combined pressure regulator and pressure tank operates otherwise in the same manner as the heretofore described combined pressure regulator and pressure tanks.

In operation, when the pump 10 is operating water will flow through pump outlet 14 to tank inlet 15 raising the diaphragm 19 away from the inlet 15 and permitting the water to flow through the outlet 17 to the system. As the system demands vary, the diaphragm will assume different positions within the container to maintain substantially uniform system pressure.

In operation, when the system pressure exceeds a predetermined value, pressure switch P will stop the operation of the pump. When the pressure in the system falls below a predetermined value, the pressure switch P will start the operation of the pump 10.

In the event that the pressure in the system falls below a predetermined pressure but the pump fails to start, due to a power failure or the like, the diaphragm 19 will move against the inlet 15 and outlet 17. This isolates the water in the system from the water in the pump. In addition, it insures that sufficient water will remain in the outlet of the pump to maintain a prime and prevent the pump from running dry.

Figure 2:
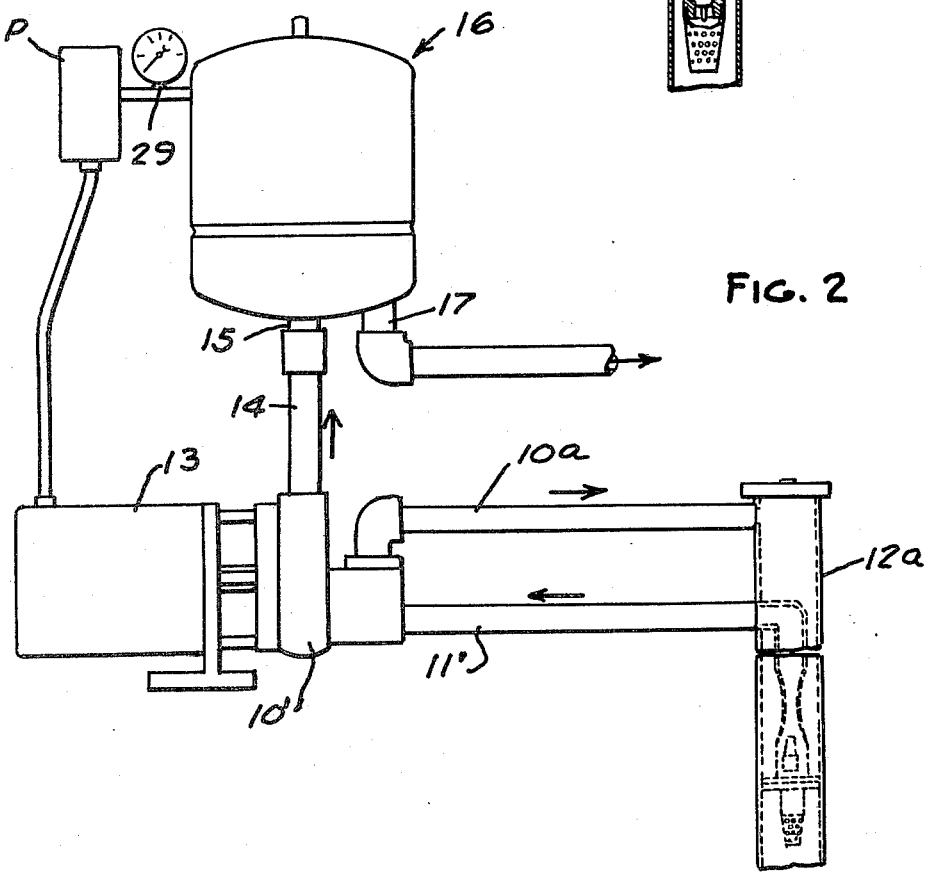
FIG. 2 is a fragmentary partly diagrammatic view of a modified form of the system.

In the form of the invention shown in FIG. 2, a deep well jet system is shown wherein the pump 10′ includes an inlet 11′ and an outlet 10a whereby a portion of the water under pressure returns to the jet assembly 12a in the well in accordance with well known practice. In all other respects the system is identical to that shown in FIG. 1.

In operation, when the pump 10′ is operating water will flow through pump outlet 14 to tank inlet 15 raising the diaphragm 19 away from the inlet 15 and permitting the water to flow through the outlet 17 to the system. As the system demands vary, the diaphragm will assume different positions within the container to maintain substantially uniform system pressure. As the height of water well varies, the diaphragm will assume different positions to maintain the desired pressure in the jet assembly to continue operation thereof. If the system demand exceeds the pump capacity, the diaphragm will move to limit output to the pump capacity.

Thus the combined pressure regulator valve and pressure tank functions as a simple and reliable flow control to replace manual, semi-automatic or automatic valves commonly used. Moreover, in the case of manual valves, they are usually set at the lowest value for which the pump is to operate. As a result, when the pump starts up, the pump will only operate at the set lowest pressure. This may be contrasted to the present invention wherein the system, on restart, will operate at higher permissible pressure since the diaphragm will move to accommodate higher output pressure.

In each of the systems described, the combined pressure regulator and pressure tank can be mounted in any position and need not be vertical as shown.

It can thus be seen that there has been provided a system where the need for an automatic, semi-automatic or manual pressure operated control is obviated; where the prime on the pump is maintained; and wherein this is achieved with a device that requires minimum maintenance.

It will also be apparent to one skilled in the art from the foregoing disclosure that in each of the systems described, the combined pressure regulator and pressure tank 16, 30–31 and 40 employed therein as a flow control in accordance with the invention is adapted to be serially connected for one-way flow therethrough of the entire water output from the well pump 10 or 10′, via the inlet 15, 35 or 46, water receiving chamber B and thence through the outlet 17, 36 or 47 of tank 16, 30–31 or 40, to a well water distribution system thus supplied by the well pump. The flow control tank itself may be further generally characterized as comprising a hollow container having a first wall, such as the lower half of container 18 with the associated plastic liner 24, the half shell 31 of FIG. 4 or the lower half shell of container 40 of FIG. 5, constructed to define a water receiving chamber such as chamber B of tank 16. The tank also has a second wall, such as that defined by the upper half of housing 18, the upper half shell 30 or the upper half of container 40, which defines a gas receiving chamber, such as chamber A of tank 16. The water inlet 15, 35 or 46 is provided in the first wall of the tank and is adapted to be connected to the outlet 14 of the well pump 10 or 10'. The first wall also has provided therein the water outlet 17, 36 or 47, adapted to be connected to the water distribution system, with the water outlet being separate from the water inlet but in relatively closely spaced adjacent relationship thereto. The tank also includes a diaphragm 19, 34 or 41 made of flexible gas and water impermeable material and secured about its periphery in sealed relation to the interior of the tank intermediate the aforementioned first and second walls so as to provide a movable barrier between the water receiving chamber and the gas receiving chamber. The diaphragm is made to conform closely to the shape of the first wall such that in the untensioned state of the diaphragm material, the diaphragm engages the first wall and extends therealong in conformity therewith in the empty condition of the water receiving chamber B. Thus, in this condition as shown in solid lines FIGS. 3, 4 and 5, the diaphragm is in its untensioned state and seals both the water inlet and the water outlet.

The tank 16, 30–31 and 40 also includes the one-way gas valve 20 mounted in the second wall adapted for coupling with a gas charging conduit, such as a conventional pneumatic tire inflation hose supplied by a compressed air source, for filling the gas chamber A with a compressible gas, usually atmospheric air, to a pressure which has initial predetermined value (such as 20 p.s.i.) when the water receiving chamber B is empty. However, over a period of time, the pressure of the gas in the gas chamber A is susceptible to fall below said initial predetermined value to a value not less than atmospheric pressure owing to the unavoidable leakage from the gas chamber via the typical inflation valve 20.

It will also be seen that the diaphragm 19 is movable by flexure thereof (such as is illustrated by comparing the solid line and dashed line positions of the diaphragm as illustrated in FIGS. 3 and 4) to inversely vary the volumes of the chambers A and B in response to water pressure variations in excess of the prevailing pressure in the gas receiving chamber A. As indicated previously, due to the relatively closely spaced relationship of water inlet 15, 35 and 46 to the associated water outlet 17, 36 or 47, the diaphragm seals against both the inlet and outlet substantially simultaneously as the water pressure falls below the aforesaid prevailing pressure and the water chamber is thus emptied. This occurs even when the gas charge is completely lost via the aforementioned leakage and thus the prevailing pressure in the gas chamber is atmospheric assuming that positive pressure conditions are also lost on the water side of the system, as occurs from power failure and resultant pump outage. Thus, it will be understood that even under such failure conditions the tank 16, 30–31 or 40 embodying the aforementioned structural features described previously reliably functions to prevent water remaining in the water inlet 15, 35 or 46 from flowing backward via the pump 10 or 10' into the well to thereby maintain a prime on the pump and prevent the pump from running dry. Hence the pump is kept in a fail-safe primed condition despite the occurrence of two possible failure modes, namely, (1) in the event of loss of motive power to the pump due to electrical outages or the like, and (2) loss of the gas charge in the gas chamber A such as by failure of the valve 20 or the unavoidable long-term leakage back to atmosphere via the valve.

It also will be evident from the foregoing disclosure that the combined pressurizing and regulating tank 16 of the invention, when combined in accordance with the invention with a water well storage and distribution system or the like, provides a new and improved well water system. This system includes the pressure switch (P) shown in FIG. 1 which is responsive to a second predetermined system pressure (i.e., 20 p.s.i. or more), not less than the aforesaid initial predetermined value of the gas in the gas receiving chamber, so as to be operable to initiate operation of the well pump. Preferably, pump turn-on is set to occur when chamber B is substantially emptied so as to maximize the water storage capability of the tank. The pressure switch is also responsive to a given system pressure (i.e., 50 p.s.i.) higher than said second predetermined pressure to stop the pump. In this manner the flow control tank and pressure switch function as a combined pressure regulator valve, water pressurizing source and loss of prime back-check valve to (1) insure the water flow from the tank outlet to the water distribution system, (2) maintain such flow as the system demands on the outlet vary and the height of the well varies, (3) limit the flow from the tank outlet as the system demands on the tank outlet exceeds the pump capacity, and (4) prevent back-flow of air into the pump and well serially via the tank outlet, chamber B and tank inlet in the event water pressure from the pump falls below said prevailing gas pressure, even including when said gas charge is completely lost and said prevailing pressure thus becomes atmospheric.

As shown in FIG. 1 as well as in FIGS. 3 and 4, pressure switch P may be connected via a line 29 in gas communication with the interior of the gas chamber A to avoid encrustation of the pressure switch. It will also be understood that with pressure switch P so connected, when the system water pressure exceeds the third predetermined value (i.e., 50 p.s.i.), pressure switch P will stop the operation of the pump because, under normal conditions, the pressure of the gas in chamber A corresponds to or is a function of the water pressure in chamber B. Likewise, when the water pressure in the system falls below the second predetermined value (i.e., 20 p.s.i. or more), the pressure switch B will start the operation of the pump because of the corresponding change in pressure of the gas in chamber A. However, it will also be understood that operation of the pump 10 and associated motor 13 may be likewise controlled by a pressure switch connected in direct liquid communication with the system water output line connected to the water outlet 17 of the tank if water encrustation of the switch is not deemed to be a problem in a given installation.

In accordance with the further objects and features of the present invention, the above described pressurizing and regulating tank 16, 30–31 or 40 is combined as a well yield control with a well water distribution system so as to serve an important basic function for every pump-operated well water system, namely, to protect the pump by matching the yield of the well to the capacity of the pump. This is a particularly important consideration in low yield well systems. Such a system is illustrated in FIG. 8 wherein those elements and components of the system previously described in conjunction with FIGS. 1 through 7 are given like reference numerals and their description not repeated for purposes of brevity.

Figure 8:
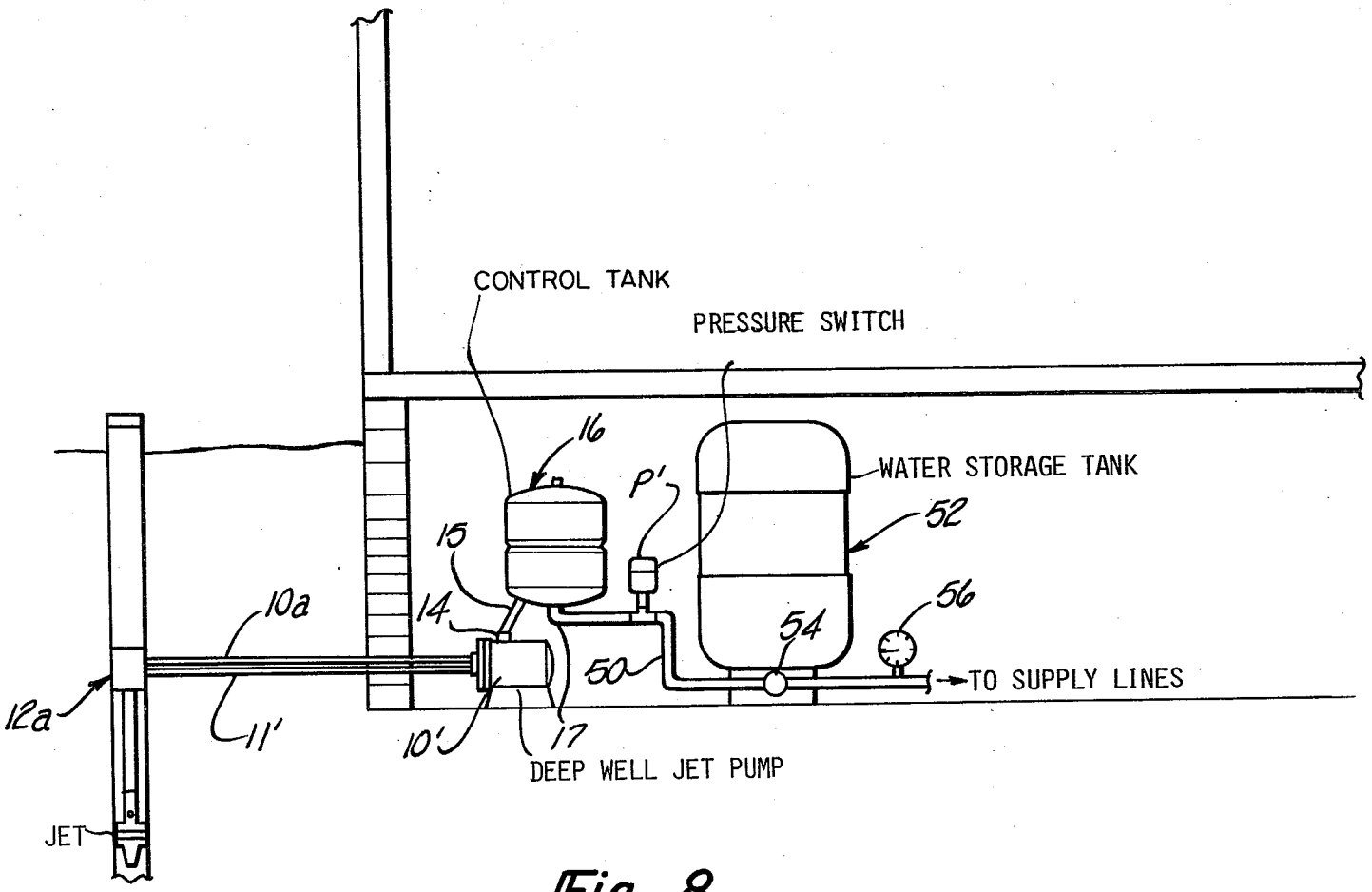
FIG. 8 is a fragmentary partly diagrammatic view of a well yield control system embodying the invention.

As shown in FIG. 8, a conventional deep well jet pump 10' is connected as described previously to the jet assembly 12*a* located in the ground water well, and the output line 14 of the pump is connected to the inlet 15 of the tank 16. The outlet 17 of tank 16 is connected via piping 50 to the supply lines communicating with the building plumbing system.

In accordance with another feature of the invention, a pre-pressurized well water storage tank 52 is connected via a two-way flow plumbing connection 54 to supply line 50 downstream of tank 16 (but in relatively close proximity thereto) and upstream of the water distribution system of the building fed by the line 50. Preferably, tank 52 is of much larger capacity than tank 16 and may comprise a commercially available expansion tank of the type disclosed and claimed in the aforementioned Kirk U.S. Pat. No. 3,524,475, which is incorporated herein by reference. Thus, fitting 54 in FIG. 8 corresponds to the fitting 28 in the Kirk patent so that the supply line 50 is in constant two-way liquid communication with the water receiving chamber of tank 52. One commercially available form of Kirk tank is that sold under the trademark WELL-X-TROL by Amtrol, Inc. of West Warrick, Rhode Island, the same being available in various draw down capacities ranging from 0.7 gallons up to 131.0 gallons.

Figure 9:
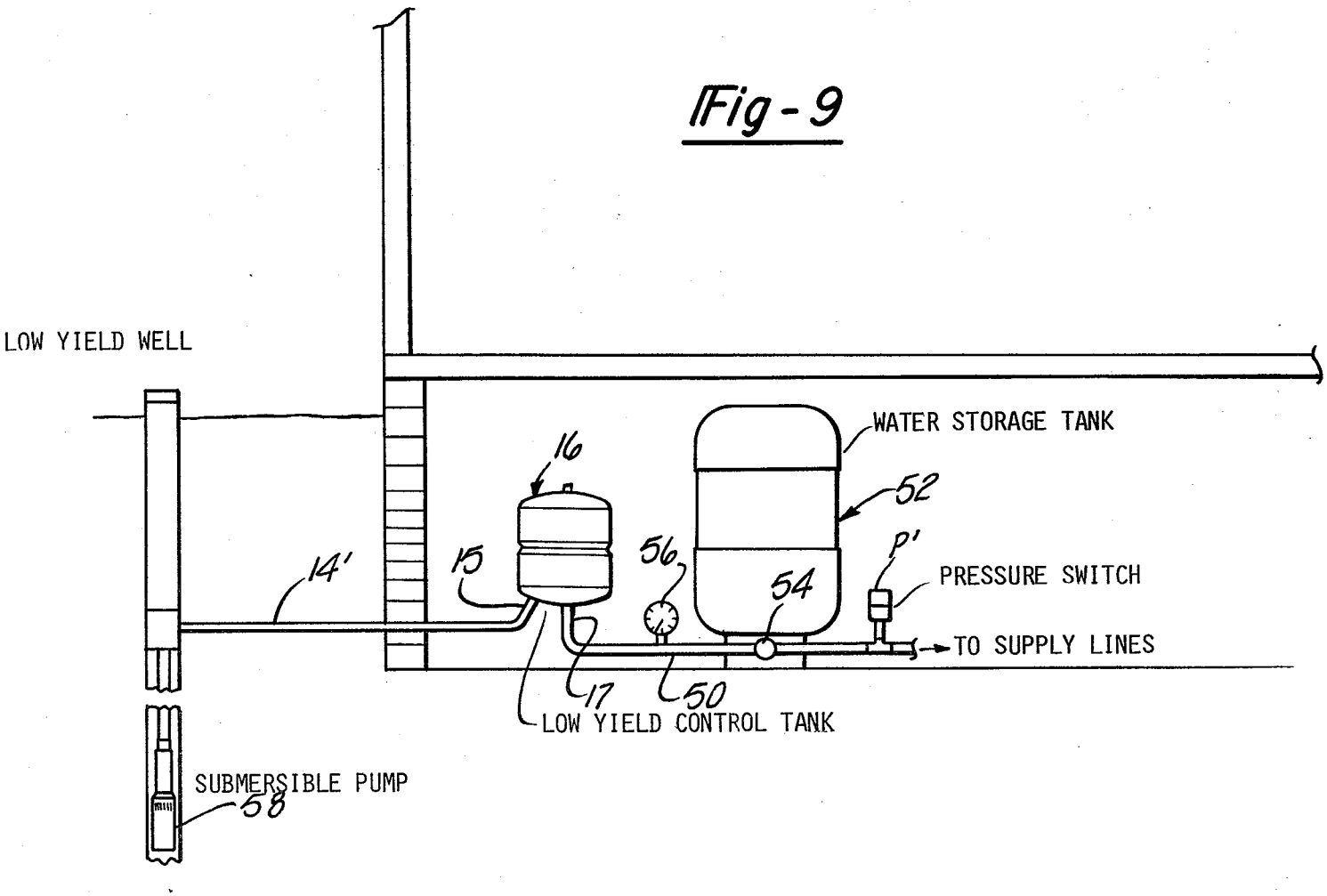
FIG. 9 is a fragmentary partly diagrammatic view of a modified well yield control system embodying the invention.
Figure 10:
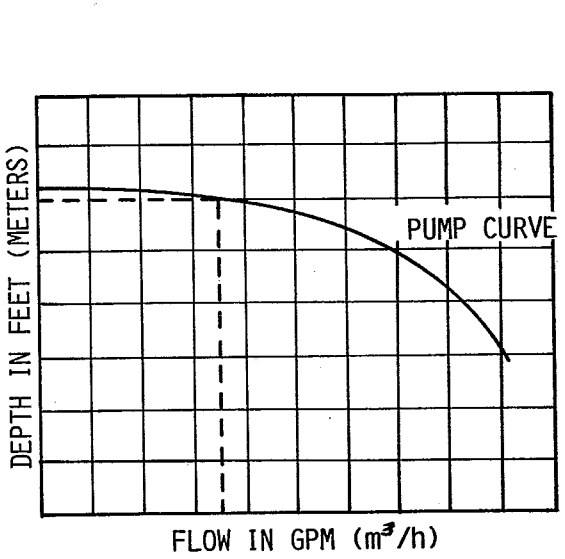
FIG. 10 is a composite fragmentary diagrammatic view with associated pump curve to facilitate understanding of a procedure employed when installing the well yield system on a new wall or a healthy yield well when the well cannot be pumped down.
Figure 10:
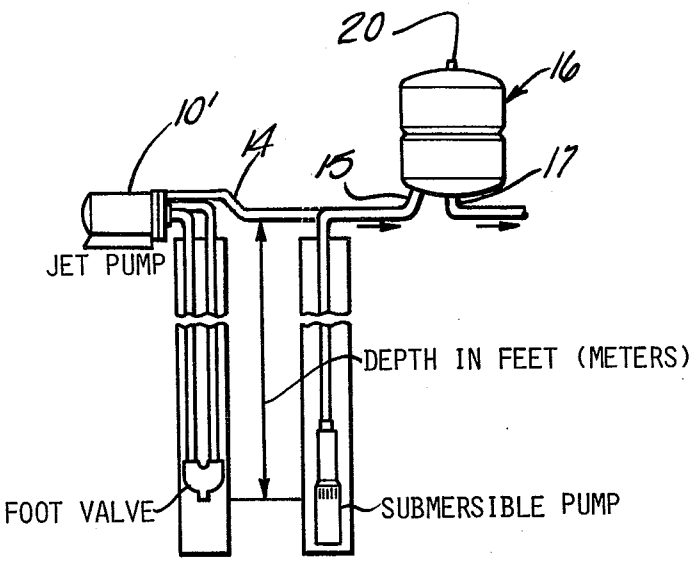

It also is to be noted that in the system connections illustrated in FIGS. 8, 9 and 10, (as well as in FIGS. 11–13) the inlet fitting of tank 16 is shown offset from the bottom center of the tank whereas the outlet fitting 17 is shown on-center. Tank 16 is thus shown connected the reverse of that of FIGS. 1, 2 and 3, which is permissible so long as the diaphragm in tank 16 is of the type illustrated in FIG. 3 wherein two thickened portions 22 and 23 are provided, one for each of the associated fittings 15 and 17 respectively. However, it has been found that if tank 16 is constructed with the flexible diaphragm illustrated in the Kirk U.S. Pat. No. 3,524,475 so that there is only a thickened portion over the central fitting, the preferred mode of operation is to employ the central fitting of tank 16 as the inlet fitting and to employ the off-center fitting as the outlet fitting.

The well yield control system of FIG. 8 also includes a pressure switch P′ of conventional construction coupled in liquid communication with the outlet line 50 and operably electrically coupled to the motor of pump 10′ so as to start and stop operation of pump 10′ in response to predetermined water pressures existing in line 50. For example, switch P′ may be set to initiate operation of pump 10′ when the pressure in line 50 is 30 p.s.i., and to shut off pump 10′ when the water pressure reaches 50 p.s.i.

With the foregoing system connections, the well yield control system of the invention utilizes the flow control tank 16 to throttle down the discharge of pump 10′ so as to maintain the water level in the well at a desired safe distance above the pump or foot valve, rather than just shutting the system down when the water level in the well drops below the pump inlet or foot valve. In this manner, pump discharge is kept to a flow equal to the yield of the well. Because the system never shuts down, manual resetting is never necessary and a flow of water is always assured. On the other hand, during normal well yield, the well yield control 16 does not interfere with system flow. As will be appreciated from the description in conjunction with FIGS. 1 through 7, the well yield control 16 is simple in design and installs easily and quickly in the system piping between the pump discharge and any other system component. It contains no mechanical linkage or cams, no electrodes or wires. Diaphragm 19, 34 or 41 is the only moving part, and the same is maintenance free and will not corrode, rust or jam.

In one preferred working embodiment of the well yield control tank 16, the following specifications are observed:

Maximum working pressure in chamber A—100 p.s.i.
Maximum operating temperature—200° F.
Shipping pressure in chamber A—0 P.S.I.G.
Shipping weight—6 pounds The aforementioned working model adapted for a plumbing system employing ¾″ NPT diameter conduit, the pressure drop through the chamber B of the well yield control tank 16 is specified as follows:

| Flow Rate in Gallons Per Minute | Pressure Drop in Pounds Per Square Inch |
|---|---|
| 2 | 0.2 |
| 4 | 0.4 |
| 6 | 0.7 |
| 8 | 1.0 |
| 10 | 1.3 |
| 12 | 1.6 |
| 14 | 1.9 |
| 16 | 2.3 |

In the well yield control system of FIG. 8, during normal system operation at full flow from the well, the control pressure in the control tank 16, i.e., the predetermined gas pressure to which chamber A is charged, is overcome by the pump discharge pressure. This causes the internal flexible diverter, i.e., diaphragm 19, to be displaced upwardly, allowing full unimpeded flow from inlet 15 through the water chamber B to the outlet 17. As the water level of the well drops, the pump discharge pressure becomes lesser than the control pressure in chamber A of tank 16. This causes the diaphragm 19 to be displaced downwardly into closer proximity to the inlet 15 and outlet 17, thereby reducing the cross-sectional area of the flow path through chamber B and thus producing a greater restriction to flow between inlet 15 and outlet 17, thereby automatically restricting the flow to match that of the minimum well yield. Therefore, the pump cannot pump beyond this yield value.

As illustrated in FIG. 8, the well yield control tank 16 is installed on the discharge side of the pump 10′ between the pump and any system component such as the pressure switch P′, a conventional relief valve (not shown) and/or the water storage tank 52. It is to be understood that it is mandatory to install control tank 16 in this location so that it will not interfere with normal system operation and will only operate during periods of low well yield. As described in conjunction with the systems of FIGS. 1 and 2, the tank 16 can be installed in either a vertical or non-vertical position.

Preferably, the well yield control tank 16 is shipped from the manufacturer to the installer without any air charge in the gas chamber A. Thus, in order for the unit to operate properly, it must always be charged with air to the correct control pressure after installation in the system. To determine this control pressure, either of the two procedures may be used.

The first procedure is employed for installing a well yield control 16 on existing well water systems when information on yield pump performance or well depth is not available. In this procedure, the steps are as follows:

1. Remove protective cap 21 from air valve 20 and connect either an air compressor or air tank in preparation for pressurizing.

2. Open system outlet fixtures as necessary to get full flow.

3. Start well pump 10'. (CAUTION: If the pump is started before the fixtures are open, damage to the unpressurized well yield control tank 16 could result.)

4. Continue to open fixtures until the water level in the well is pumped down to the level of the pump suction. At this point, air will be drawn into the pump, and the water flow at the fixtures will "splutter". In addition, the needle on the pressure gauge 56 will "flutter".

5. Continue pump operation for several minutes so that conditions in the well can stabilize.

6. Gradually add air to the well yield control tank 16 with the air compressor or air tank.

7. When the "spluttering" ceases and a continual flow of air-free water is obtained at the fixtures and the pressure gauge needle steadies, the proper pressurization of chamber A of tank 16 has been reached.

8. Increase the control pressure by an additional 2 or 3 p.s.i. (25 kPa) by adding more air to provide a safety reservoir of water above the pump suction inlet.

9. Shut fixtures, allowing pump to shut off and installation is complete.

The second procedure is used when installing the well yield control tank 16 on a new well or healthy yield well when the well cannot be pumped down due to the rate of ground water flowing to the well exceeding the pump capacity.

Regardless of which procedure is employed the control pressure valve in most installations will be at some minimum value, such as 70 p.s.i., greater than the maximum design pressure of tank 52, i.e., the aforementioned 50 p.s.i. pump turn-off pressure.

Referring to FIG. 9, a modified low yield well control system is illustrated which is similar to the system illustrated in FIG. 8, except that the well is equipped with a submersible pump 58 the output line 14' of which is connected to the inlet 15 of the well yield control 16. Also, alternative locations of the pressure gauge 56 and pressure switch P' are illustrated, the same being on the opposite sides of the connection 54 of the water storage tank 52 to the line 50. The system of FIG. 9 operates in the same manner as FIG. 8 and the above described installation procedures likewise are equally applicable thereto.

In addition to the above described well yield control function of flow control tank 16, i.e., matching the yield of the well to the capacity of the pump, the tank 16 in the systems of FIGS. 8 and 9 continues to perform the basic functions of, and provides the advantages of, the combined pressure regulating and pressure tank of the systems of FIGS. 1 and 2 described previously. In other words, in the event of electrical power failure causing the stoppage of the well pump in the system, initially the water storage reservoirs of both tank 16 and tank 52 will continue to supply water under pressure to the supply lines of the plumbing system fed by the well water system. During this draw down of tanks 16 and 52, system water pressure will drop in accordance with user demand. Therefore, diaphragm 19 in tank 16 will be diverted downwardly by gas pressure in chamber A until it seals the inlet 15 and outlet 17. This shut-off condition will normally occur in tank 16 prior to the diaphragm in tank 52 reaching its lowermost position because of the lower operating pressure range of tank 52. As the reservoir of pressurized water in tank 52 is depleted by continued demand for water in the plumbing system, the system water pressure will eventually drop below the 30 p.s.i. exemplary cut on point. However, with no electrical power available the pump will not be turned on. Under such conditions it is possible that eventually both the water chamber of tank 16 and the water chamber of tank 52 will be emptied by continued drainage into the household plumbing system, dropping the water system pressure down to atmospheric. If a faucet is left open, air will attempt to drain back from the household system via line 50 due to the suction head of the well level relative to that of the water distribution system, and the normal ability of the pump to leak backwardly when in the off condition. However, such back-flow and resultant loss of prime for the pump will not occur because diaphragm 19 in tank 16 is in sealed relation with the outlet 17 and inlet 15 of the tank.

Moreover, this fail-safe feature will be maintained indefinitely even if there is a loss of the gas charge in chamber A of tank 16 because, in accordance with the previously described feature of the invention, diaphragm 19 in its normally untensioned state has a condition of respose (as shown in solid lines in FIG. 3) wherein the diaphragm is in sealing relation with the inlet 15 and outlet 17 of tank 16. In addition, the suction in line 14 exerted by the negative head of water therein will tend to draw diaphragm 19 into tighter sealed relation with inlet 15. Of course, the same features and advantages apply if the modified pressure regulating and pressure tanks of FIG. 4 or 5 are substituted for tank 16.

Figure 11:
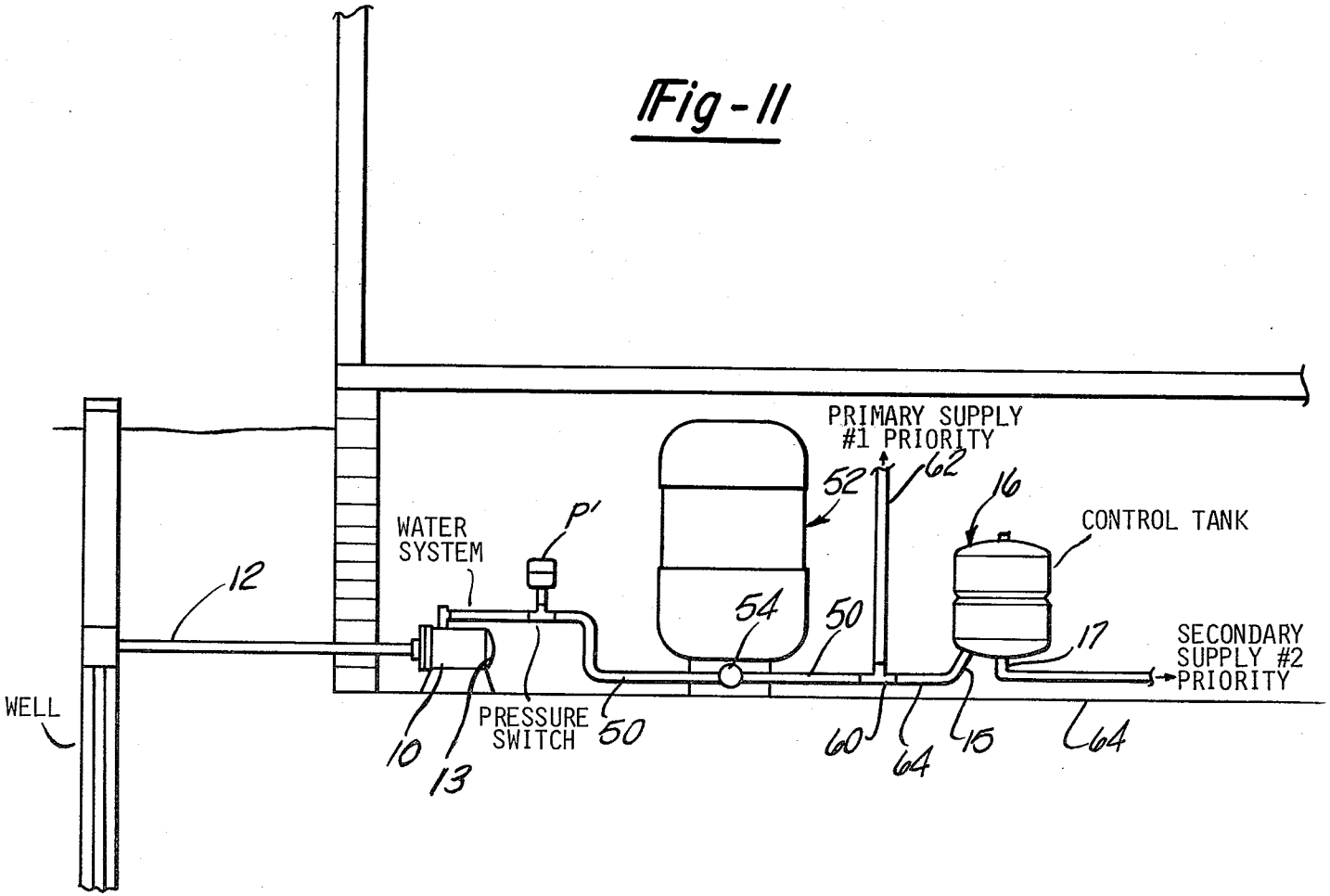
FIG. 11 is a fragmentary partly diagrammatic view of a further system of the invention employing the flow control tank of the invention to insure priority of supply between two or more branch outputs supplied by the well water system.

Referring to FIG. 11, another well water control system of the invention is illustrated diagrammatically wherein the elements thereof previously described are given the same reference numerals or characters and their description not repeated. In this system the output line 50 downstream of the water storage tank 52 is connected via a T-fitting 60 to a first branch supply line 62 and a second branch supply line 64. Line 62 is connected to the distribution system requiring primary supply of water and therefore having first priority for water supply from the water system. The second branch 64 is intended to supply water from the water system to a distribution system having a secondary priority. One example of such dominant and subsidiary relationship might be the supply of water to a farm residence whose plumbing system would be connected to line 62 since household uses might be deemed to have first priority, depending on the preference of the system user. The secondary priority then might be allocated to the barn plumbing system, and this system thus supplied via the second branch line 64.

In order to accomplish the above apportionment feature of the invention, the combined pressure regulating and pressurizing flow control tank 16 is connected for serial flow in branch line 64 as illustrated in FIG. 11. Depending upon the normal operating pressure range of the associated water well system, gas chamber A of tank 16 is pre-charged to a predetermined pressure, for example, 30 pounds per square inch. Hence, during normal operation when the water system and the associated tank 52 are functioning to deliver pressurized water to line 62 and 64 at a pressure above 30 pounds per square inch, water can be supplied to either or both of lines 62 and 64 to satisfy the demand of the household system and/or the barn system. However, if the demand for water exceeds the capacity of the water system pump and pressure tank 52, thereby causing system pressure to drop to the 30 p.s.i. minimum air pressure value of chamber A, diaphragm 19 in tank 16 will be forced to its closed sealing position illustrated in FIG. 3, thereby stopping flow through branch line 64 to the barn system. This will leave the remaining capacity of the water supply system available for supplying the higher priority household demand via the first branch line 62. Control tank 16 will continue to maintain the secondary supply shutoff until the primary system demand drops off to a rate where the system pressure can again build up over the 30 p.s.i. charge pressure of tank 16, whereupon the water pressure in line 64 will flex the diaphragm 19 upwardly out of sealed relation with the inlet 15 and outlet 17 to enable water to again flow via line 64 to the lower priority secondary water distribution system, i.e., into the barn plumbing system in the aforementioned example.

Although the system shown in FIG. 11 does not function to prevent loss of prime on the pump as a result of power failure and back flow leakage via line 62, control tank 16 will function to prevent loss of prime insofar as the same might otherwise be caused by back flow leakage from the secondary distribution system via line 64 into line 50 and through the water system and well pump into the well. This is true even if control tank 16 suffers from gas pressure leakage from chamber A as described previously. However, if desired such loss of prime protection for the entire branched distribution water system can be accomplished by adding another control tank 16 serially in line 62, with such second tank 16 having a head space pressure recharge value less than that of the tank 16 in line 64 so as to retain the priority rationing between the respective primary and secondary water outlet systems served by branch 62 and 64. Alternatively, a second small flow control tank 16 may be serially connected with the pump output line 14 upstream of fitting 60, or the large storage tank 52 can be modified and converted into a flow control tank similar to tank 16 by providing the separate, relatively closely spaced inlet 15 and outlet 17 and cooperative diaphragm 19 and connected for serial flow in line 50, so as to obtain the dual fail-safe loss of prime protection offered by systems of FIG. 1 and/or FIG. 3. In addition, the low yield well control system of FIG. 8 or 9 may also be employed in combination with the rationing system of FIG. 11 to obtain the combined function advantages of all three systems.

Figure 12:
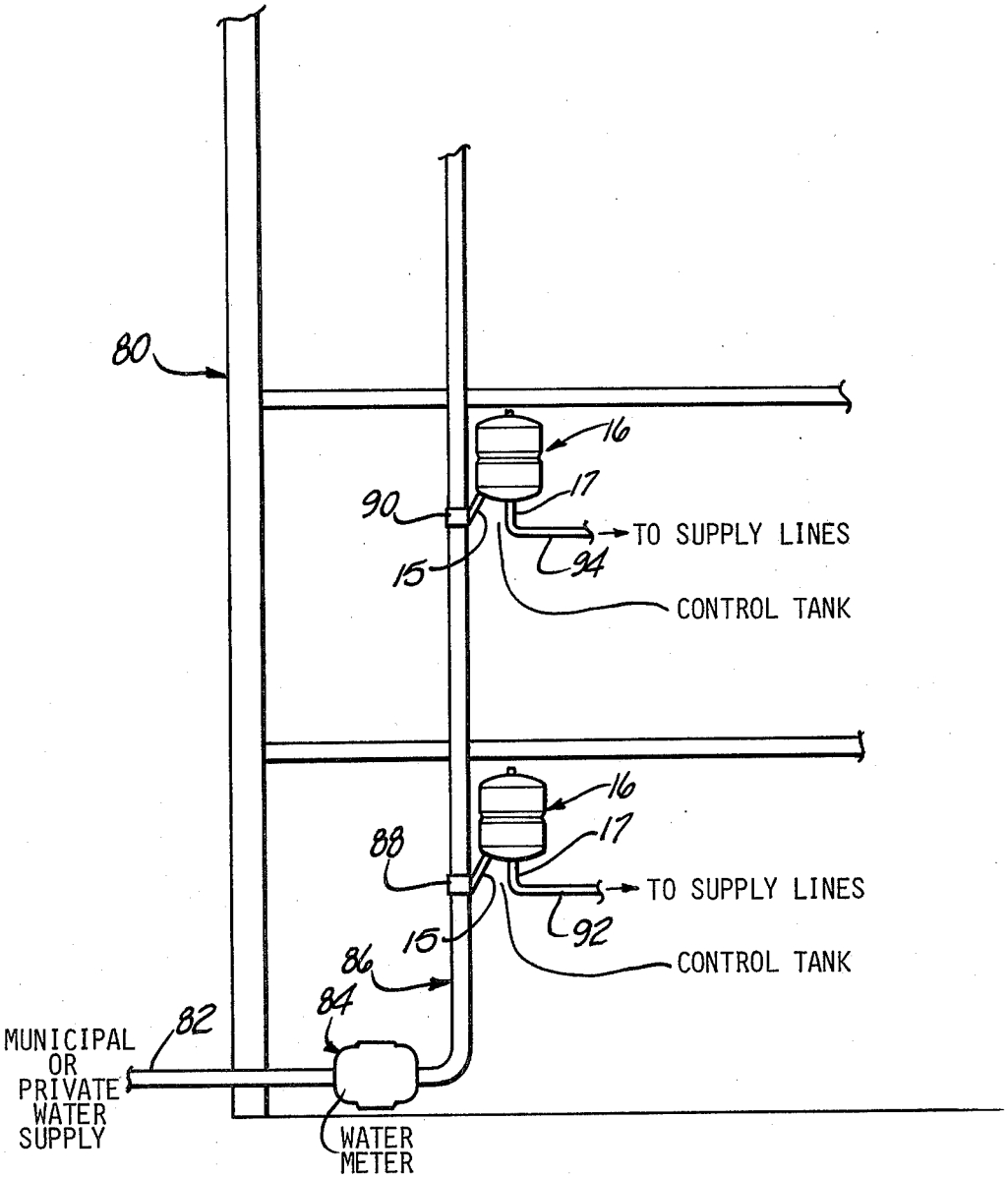
FIG. 12 is a fragmentary partly diagrammatic view of a back flow control system embodying the invention to prevent water source contamination.

Referring to FIG. 12, another system of the invention is illustrated diagrammatically in which the combined pressure regulator and pressure control tank 16 is employed as a back flow control unit to prevent water source contamination. As shown by way of example in FIG. 12, a municipal or private water supply is connected to supply water to a multi-story structure 80. The water supply is connected to the structure by a main supply line 82 brought into the basement or cellar first level of the building and plumbed through a conventional water meter 84 to a vertical riser supply line 86. At each level of the building a tap-off T-fitting 88, 90 etc., is provided in line 86. At the first level, a tank 16 has its inlet 15 connected to fitting 88 and its outlet 17 connected to a branch supply line 92 feeding the plumbing system of the first level of the building. Similarly, at the second level of the building another tank 16 has its inlet 15 connected to fitting 90 and its outlet 17 connected to a branch supply line 94 feeding the water distribution system of the second level of the building.

Each of the tanks 16 is either precharged, or charged at the time of installation, with compressed air to pressurize the gas receiving chamber A to a predetermined pressure established at some given value less than the estimated minimum pressure of the water system supply line 82 at each tank installation point. For example, a charge pressure of 20 p.s.i. and thus 10 p.s.i. less than the expected normal minimum pressure of say 30 p.s.i. of the main water supply at fitting 88 for tank 16 installed at the lowest elevation. For the next higher tank 16 at fitting 90, the predetermined charge pressure will be reduced by an amount equal to 0.433 times the difference in elevation in feet between fittings 88 and 90, and so on for the tanks at higher elevations. This will provide substantially simultaneous back flow closure at all elevations. Thus, normally the system water pressure in line 86 is adequate to flex the diaphragm 19 in each of the tanks 16 upwardly to its open condition to permit water to flow serially through tank inlet 15, water chamber B and out of outlet 17 into the associated branch supply lines 92, 94, etc. at each level of building 80. However, if for any reason the main water pressure feeding the building should drop below 20 p.s.i., the tank 16 at each level will function as a back check valve due to the head space pressure causing the diaphragm 19 to seal the inlet 15 and outlet 17 of such tank. Hence in the event of abnormally low pressure conditions or total outage of the main water supply system, each unit 16 will prevent back flow of water from the associated branch distribution system into the main supply line 86 to prevent contamination of the municipal supply via line 82.

Moreover, in the case of a multiple level structure, sich as building 80, the gravity pressure head varies with the elevation of each vertically arrayed branch water distribution system. Thus a condition may be encountered where at the first level more than twenty pounds per square inch of pressure exists at fitting 88 and hence water supply is available via line 92 for the lower elevation, whereas at fitting 90 less than the corresponding pressure (20 p.s.i. less 0.433 per foot of elevation difference) is available and hence the tank 16 in line 94 will be in its closed condition. Accordingly, the system of FIG. 12 then functions to prevent back flow from the branch water distribution line 94 into run 86, thereby preventing interlevel contamination as well as contamination of the main water supply. Preferably, at each higher elevation the associated back flow control tank is pre-charged to a value equal to the pre-charge value of the lowest minus 0.433 times the intervening elevational difference in feet plus 1 p.s.i. times the number of intervening building levels. This will provide protection against back flow contamination by causing sequential shut-off beginning at the uppermost branch level and in descending order as system pressure drops.

Should loss of tank head space pressure occur via the charging valve of one or more of the tanks 16, this will represent a malfunction relative to optimum performance of the system but each tank 16 is nevertheless fail-safe in that it can continue to function as a back check valve once the system pressure at the inlet 15 of any given tank 16 drops to the prevailing pressure in head space of such tank. Thus, even in the extreme case of head space A completely losing its gas charge so as to drop its chamber A to atmospheric pressure, back check operation still occurs when the water pressure sensed at the inlet 15 of such a tank drops to atmospheric pressure. Thus even under such conditions, interlevel contamination cannot result and back flow protection remains for the water main feeding the building.

Figure 13:
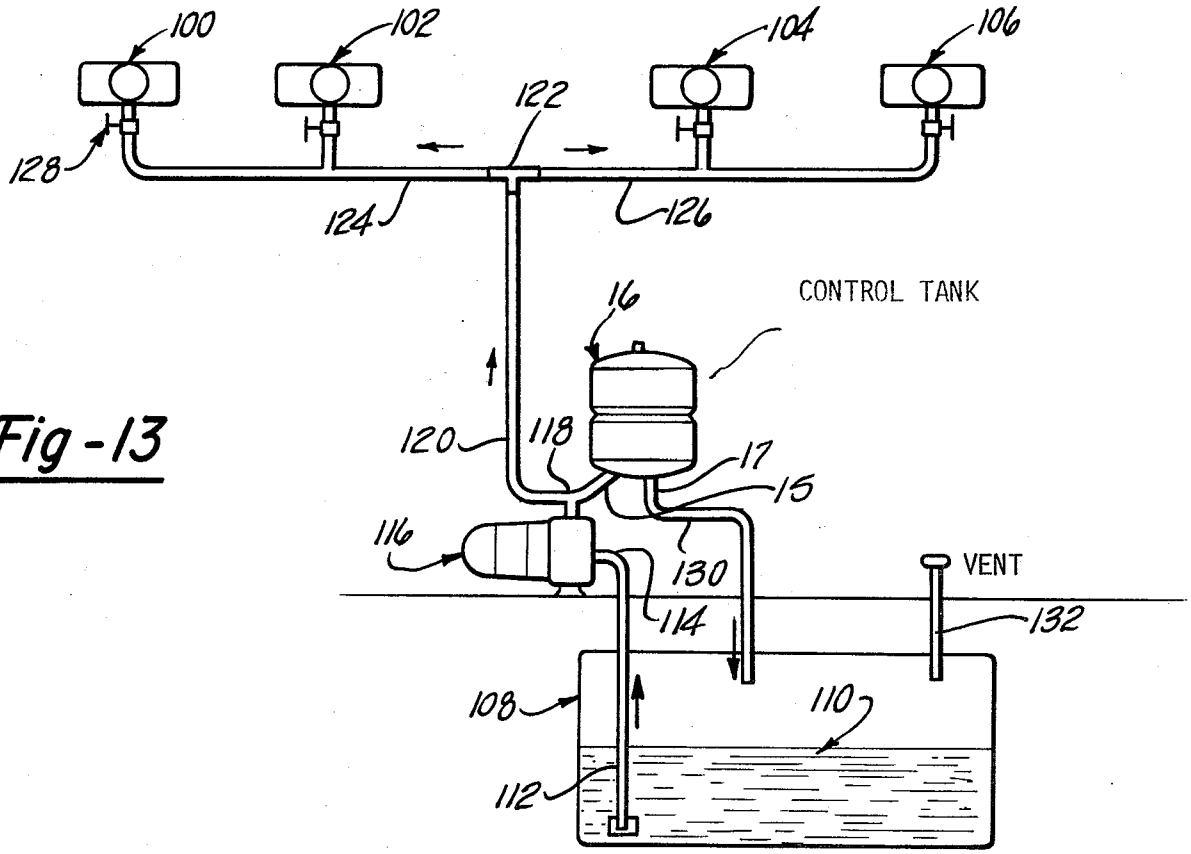
FIG. 13 is a fragmentary partly diagrammatic view of a control system embodying the invention for supplying fuel oil to a plurality of oil burners under a predetermined uniform pressure.

Referring to FIG. 13, another system of the invention employing the flow control tank 16 is illustrated diagrammatically, with those elements described previously being given the same reference numerals. In the system of FIG. 13, tank 16 functions as a pressure regulating bypass control tank to insure an automatic supply of fuel oil under a predetermined uniform pressure to a plurality of oil burners 100, 102, 104 and 106, or similar pressure liquid consuming devices such as the paper pump machines illustrated in Bachus U.S. Pat. No. 2,895,505. Thus, referring to FIG. 13, a tank or chest 108 is provided for containing a supply of fuel oil 110 or other liquid, such as paper pulp stock, depending upon the nature of the particular system. A conduit or pipe line 112 is connected at its lower inlet end to a lower portion of the supply tank 108 at its upper end to the inlet fitting 114 of a centrifugal stock or feed pump 116. The outlet of pump 116 is coupled by via one outlet of a T-fitting 118 to the inlet 15 of the tank 16, and the other outlet of the T-fitting is coupled to a main supply line 120. Line 120 in turn is coupled by a T-fitting 122 to the branch lines 124 and 126 which in turn feed burners 100 and 102 and burners 104 and 106 respectively. Each burner has an associated shutoff valve 128 to enable the burners to be individually connected to and disconnected from the associated fuel supply lines 124 and 126. The outlet 17 of tank 16 is connected via a return line 130 which is open at its outlet to the reservoir in tank 108. In the example illustrated, tank 108 is a closed tank buried below ground level and has the usual vent pipe 132.

Pump 116 has a capacity greater than that required to supply fuel oil to the battery of burners 100–106 so that a portion of the output of pump 116 is always returned from the outlet of the pump via fitting 15, the liquid receiving chamber B of tank 16, outlet fitting 17 and line 130 back to the tank 108 in bypass relation to the main fuel supply system 120, 124, 126. Chamber A of control tank 16 is thus precharged with sufficient air pressure to allow the pump to furnish fuel oil to one or more of the burners 100–106 at a constant pressure, with the surplus returning to tank 108. In operation, the air charge in head space A of tank 16 provides a variable rate air spring which flexes diaphragm 19 downwardly so as to vary and thereby control the cross-sectional area of the flow path passage and hence the flow restriction between inlet 15 and outlet 17 via chamber B, thereby controlling the pressure of the fuel oil in line 120 so that the same is maintained at a uniform value regardless of the flow rate demanded by the burners. Thus tank 16 automatically controls the pressure in line 120 so that the same is maintained at a uniform value regardless of whether one, two, three or four of the burners 100–106 are being supplied with fuel oil via the associated feed lines 124 and 126.

In other words, the system of FIG. 13 does not work as the plural feed system of the aforementioned Bachus U.S. Pat. No. 2,895,505 but in a simplified and improved manner. By connecting tank 16 in bypass relation to the fuel supply line 120 directly at the outlet of pump 116, there is no need for the closed loop of the Bachus system, resulting in a significant savings in the amount of piping required in the supply system. Moreover, because of previously described features of tank 16, the same embodies the advantages of the aforementioned Kirk U.S. Pat. No. 3,524,475, i.e., separation of the head space from the liquid space by a diaphragm to prevent absorption of the liquid in the gas and elimination of corrosion problems due to the plastic liner 24 shown and described in conjunction with FIG. 3 herein. In addition, tank 16 provides its own pressure source by having the charged head space A and the same can be readily precharged or charged at installation to whatever predetermined air pressure is required to insure the uniform supply of liquid at a constant pressure to the supply lines 120, 124 and 126.

From the foregoing description, it will now be apparent that the combined pressure regulator and pressure flow control tank in its various forms 16, 30–31 and 40 has many uses and advantages in pressurized liquid distribution systems, whether they be water well systems, municipal water systems or fuel supply systems as illustrated, described and claimed herein in various combinations pursuant to the present invention. The flow control tank 16 thus embodies all of the advantages of the expansion tank of the Kirk U.S. Pat. No. 3,524,475 and like the Kirk tank can serve as a liquid storage and pressurizing tank in a liquid distribution system. However, unlike the Kirk tank, the flow control tank of the invention has the separate but relatively closely spaced inlet 15 and outlet 17 arranged in chamber B in cooperative relation with the mutually sealing diaphragm, and this diaphragm in its untensioned state has a natural stage of repose in sealing relation to the inlet and outlet. Accordingly, the flow control tank of the present invention provides the additional functions and advantages disclosed and claimed herein, i.e., a back check valve to prevent loss of pump prime in a well system regardless of loss of pump power and loss of head space charge, and a pressure regulating valve for automatically controlling flow in response to liquid pressure feed variations existing at the inlet 15 due to the compressible gas charge in chamber A operating as a bias on the diaphragm 19. It is thus to be understood that the above-described systems and components are illustrative of the application of the principles of this invention, and that numerous other arrangements may be readilly devised by those skilled in the art pursuant to the present disclosure which will embody the principles of the invention and fall within the spirit and scope thereof.

I claim:

1. A closed water pressurizing and regulating tank adapted to be serially connected for one-way flow of the entire water output from a well pump via said tank to a well water distribution system supplied by said well pump, said tank comprising a hollow container having (1) a first wall defining a water receiving chamber, (2) a second wall defining a gas receiving chamber, (3) a diaphragm made of flexible gas and water impermeable material and secured about its periphery in sealed relation to the interior of said tank intermediate said first and second walls so as to provide a movable barrier between said chambers, said diaphragm being made to conform to the shape of said first wall such that in the untensioned state of said diaphragm material said diaphragm extends along said first wall in conformity therewith when the pressure in said gas chamber is atmospheric and the pressure in said water chamber is no greater than atmospheric, (4) a water inlet in said first wall adapted to be connected to the outlet of the well pump, (5) a water outlet in said first wall adapted to be connected to the water distribution system, said water outlet being separate from said water inlet but in relatively closely spaced adjacent relationship with said water inlet, (6) said diaphragm normally being untensioned and in sealing position with both said water inlet and water outlet when the pressure in said gas chamber is at or above atmospheric and the pressure in said water chamber is no greater than that required to move said diaphragm away from said water inlet and outlet for the pressure prevailing in said gas chamber, (7) a one-way gas valve in said second wall adapted for coupling with a gas charging conduit for filling said gas chamber with a compressible gas to a predetermined pressure above atmospheric to maintain said diaphragm in said untensioned sealing position conforming to said first wall and sealing said water inlet and outlet when the water pressure at said water inlet is at or below said predetermined pressure, said predetermined gas pressure corresponding to the pressure to which the pump in the wall system is responsive to energize the pump to supply water to the water distribution system serially via said water inlet, said water chamber and said water outlet at a pressure in excess of said predetermined pressure, said diaphragm being movable by flexure thereof to inversely vary the volumes of said chambers in response to water pressure variations in excess of said predetermined gas pressure, said diaphragm sealing against both said inlet and outlet substantially simultaneously as the water pressure falls below said predetermined pressure so as to prevent water remaining in said water inlet from flowing backward via the pump into the well to thereby maintain a prime on the pump and prevent the pump from running dry even when the gas pressure in said gas chamber falls below said predetermined gas pressure but is in excess of the prevailing water pressure, whereby the pump is kept in a fail-safe primed condition both in the event of loss of motive power to the pump and loss of the gas charge in said gas chamber.

2. The invention according to claim 1 and further including in combination therewith a water well storage and distribution system in which said tank water inlet is in fluid communication with the outlet of a water pump of the well system and said tank water outlet is in fluid communication with said water distribution system, said system including a pressure switch responsive to a first pressure value corresponding to said predetermined gas pressure to initiate operation of said pump and responsive to a second pressure value higher than said first pressure value to stop said pump such that said diaphragm closes said tank water inlet and outlet substantially simultaneously only at water pressures below said predetermined gas pressure whereby said tank and switch function as a combined pressure regulator valve, water pressurizing source and loss of prime back-check valve to insure the water flow from the tank outlet to the water distribution system, to maintain such flow as the system demands on the outlet vary and the height of the well varies, to limit the flow from the tank outlet as the system demand on said tank outlet exceeds the pump capacity, and to prevent back flow of air into said tank inlet and pump serially via said water distribution system, said tank outlet and said tank water chamber in the event water pressure from said pump falls below the pressure of the gas in said gas chamber and/or gas pressure in said gas chamber falls below said predetermined gas pressure and is in excess of the water pressure prevailing at said inlet and outlet.

3. The invention set forth in claim 2 wherein said pressure switch is in gas communication with the interior of said gas chamber and wherein said pump comprises a deep well pump and associated deep well jet system.

4. A closed water pressurizing and regulating flow control tank adapted to be serially connected for one-way flow of the entire water output from a well pump via said tank to a well water distribution system supplied by said well pump, said tank comprising a hollow container having (1) a first wall defining a water receiving chamber, (2) a second wall defining a gas receiving chamber, (3) a water inlet in said first wall adapted to be connected to the outlet of the well pump, (4) a water outlet in said first wall adapted to be connected to the water distribution system, said water outlet being separate from said water inlet but in relatively closely spaced adjacent relationship with said water inlet, (5) a diaphragm made of flexible gas and water impermeable material and secured about its periphery in sealed relation to the interior of said tank intermediate said first and second walls so as to provide a movable barrier between said chambers, said diaphragm being made to conform closely to the shape of said first wall such that in the untensioned state of said diaphragm material said diaphragm engages said first wall and extends therealong in conformity therewith in the empty condition of said water receiving chamber, said diaphragm thereby sealing said water inlet and said water outlet in the untensioned state of said diaphragm, (6) a one-way gas valve in said second wall adapted for coupling with a gas charging conduit for filling said gas chamber with a compressible gas to a pressure which has an initial predetermined value when the water receiving chamber is empty and unpressurized, (7) said diaphragm being movable by flexure thereof to inversely vary the volumes of said chambers in response to water pressure variations in excess of the pressure prevailing in said gas receiving chamber when said water chamber is empty, said relatively closely spaced relationship of said water inlet and outlet being such that said diaphragm seals against both said inlet and outlet substantially simultaneously as the water pressure falls below said prevailing pressure, including when said gas charge is completely lost and said prevailing pressure is atmospheric, so as to prevent water remaining in said water inlet from flowing backward via the pump into the well to thereby maintain a prime on the pump and prevent the pump from running dry, whereby the pump is kept in a fail-safe primed condition both in the event of loss of motive power to the pump and loss of the gas charge in said gas chamber.

5. A pressurizing and regulating tank according to claim 4, and further including in combination therewith a water well storage and distribution system in which said tank water inlet is in fluid communication with the outlet of a water pump of the well system and said tank water outlet is in fluid communication with said water distribution system, said system including a pressure switch responsive to a first predetermined water pressure in said system to initiate operation of said pump and responsive to a second predetermined water pressure in said system higher than said first predetermined pressure to stop said pump, whereby said tank and switch function as a combined pressure regulator valve, water pressurizing source and loss of prime back-check valve to insure the water flow from the tank outlet to the water distribution system, to maintain such flow as the system demands on the outlet vary and the height of the well varies, to limit the flow from the tank outlet as the system demand on said tank outlet exceeds the pump capacity, and to prevent back flow of air into said tank inlet and pump serially via said water distribution system, said tank outlet and said tank water chamber in the event water pressure from said pump falls below said prevailing gas pressure, including when said gas charge is completely lost and said prevailing pressure is atmospheric.

6. The combination according to claim 5, wherein said pressure switch is in gas communication with the interior of said gas chamber and wherein said pump comprises a deep well pump and associated deep well jet system.

7. The combination set forth in claim 5 and further including in combination therewith a second water storage tank in fluid communication with said water distribution system downstream of said first-mentioned tank, said second tank having a flexible diaphragm therein dividing the interior of said second tank into a water receiving and pressurizing chamber and a gas receiving chamber precharged to a first predetermined pressure in the empty condition of said water chamber when the water pressure therein is at or below said first predetermined water pressure, said second tank being operable to receive water flowing from said water pump via said first tank to fill said second tank water receiving chamber until the resulting flexure of the diaphragm therein compresses the gas in said gas chamber to a higher pressure corresponding to said second predetermined water pressure, said first tank being charged to a control pressure sufficient to throttle the output flow from said pump to a flow rate less than the yield rate of the water well of said system when the level of the water in the well is at a predetermined minimum level condition, said diaphragm of said first tank being forced by the pressurized gas in said gas receiving chamber of said first tank into close juxtaposition to said inlet and outlet thereof to thereby restrict the cross-sectional flow area between said first tank inlet and outlet via said water receiving chamber thereof to thereby restrict the flow of the pump to match the flow of the minimum well yield and thus match the yield of the well to the capacity of said pump, thereby maintaining the water level in the well at or above said predetermined minimal level.

8. The combination set forth in claim 7 wherein said control pressure in said first tank has a minimum value greater than said second predetermined water pressure.

9. The combination set forth in claim 7 wherein said pressure switch communicates with said water distribution system downstream of said first tank and in relatively close proximity to said second tank.

10. The combination set forth in claim 7 wherein the maximum volume of the water receiving chamber of said second tank is many times the maximum volume of the water receiving chamber of said first tank.

11. The combination set forth in claim 5 wherein said gas receiving chamber of said pressurizing and regulating tank is charged to a control pressure sufficient to throttle the output flow from said pump to a flow rate less than the yield rate of the water well of said system when the level of the water in the well is at a predetermined minimum level condition, said diaphragm being forced by the pressurized gas in said gas receiving chamber into close proximity to said inlet and outlet of said tank to thereby restrict the cross-sectional flow area between said regulating tank inlet and outlet via said water receiving chamber such that the flow of the pump matches the flow of the minimum well yield to thereby match the yield of the well to the capacity of said pump and thus maintain the water level in the well at or above said predetermined minimal level.

12. The combination set forth in claim 11 wherein said pressure switch communicates with said water distribution system downstream of said regulating tank and in relatively close proximity thereto.

13. The combination set forth in claim 5 wherein said water distribution system further includes a diaphragm-type water pressurizing storage second tank having a water receiving chamber and a precharged gas receiving chamber separated from one another by said diaphragm, said second tank water chamber being in fluid communication with the outlet of said water pump upstream of the inlet of said first-mentioned tank, a primary water distribution conduit in fluid communication with the outlet of said pump upstream of the inlet of said first tank, a secondary water distribution water conduit connected to said water outlet of said first tank, said gas receiving chamber of said first tank being precharged to a given control pressure in the empty unpressurized condition of the water receiving chamber of said first tank, said given control pressure being equal to or greater than said first predetermined water pressure whereby said first tank is operable to flex said diaphragm therein into said sealing condition against both said first tank inlet and outlet when the water pressure in said water distribution system at the inlet of said first tank drops to said control pressure to thus shut off flow of water into said secondary conduit so that said system can maintain water supply into said primary conduit under such low-pressure conditions, said first tank being operable to open flow into said secondary conduit when the water system pressure rises above said control pressure so that the system can then feed both said primary and secondary conduits.

14. A back flow control system to prevent water source contamination in a vertically arrayed multilevel plural branch water distribution system, said system including a source of water under pressure, a water main conduit connected to said source and having a run rising vertically from the connection of said main to said source through a multiplicity of water distribution levels arrayed in vertically ascending order, a plurality of water distribution branch lines one connected to said main run at each of said distribution levels, and a plurality of back flow control tanks each having a water inlet and water outlet serially connected into and associated with one of said branch lines in close proximity to the connection of the associated branch line to said main run, each said control tank comprising a hollow container having, a first wall defining a water receiving chamber, a second wall defining a gas receiving chamber, said water inlet being in said first wall, said water outlet also being in said first wall separate from said water inlet but in relatively closely spaced adjacent relationship with said water inlet, a diaphragm made of flexible gas and water impermeable material and secured about its periphery in sealed relation to the interior of said tank intermediate said first and second walls so as to provide a movable barrier between said chambers, said diaphragm being made to conform closely to the shape of said first wall such that in the untensioned state of said diaphragm material said diaphragm engages said first wall and extends therealong in conformity therewith in the empty condition of said water receiving chamber, said diaphragm thereby sealing said water inlet and said water outlet in the untensioned state of said diaphragm, a one-way gas valve in said second wall adapted for coupling with a gas charging conduit for filling said gas chamber with a compressible gas to a pressure which has an initial predetermined value when the water receiving chamber is empty and unpressurized, said diaphragm being movable by flexture thereof to inversely vary the volumes of said chambers in response to water pressure variations in excess of the pressure prevailing in said gas receiving chamber when said water chamber is empty, said relatively closely spaced relationship of said water inlet and outlet being such that said diaphragm seals against both said inlet and outlet substantially simultaneously as the water pressure falls below said prevailing pressure, including when said gas charge is completely lost and said prevailing pressure is atmopsheric, so as to prevent water remaining in said water inlet from flowing backward via the associated branch line into said main run, said gas receiving chamber of said tank being charged to a given gas control pressure in the empty unpressurized condition of said water receiving chamber, said control pressure being less than the normal minimum pressure supplied from said source under normal operating conditions established for said water source whereby in the event of water pressure at the inlet of each said tank dropping below the control pressure of said tank said diaphragm therein closes said tank inlet and outlet to thereby prevent back-flow of water from the associated branch line into said main run.

15. In a system for supplying liquid at a uniform pressure to a plurality of liquid dispensing devices such as oil burners or the like while permitting the devices to be individually connected to and disconnected from the system, the combination comprising means for containing a supply of the liquid, a first supply line having an intake portion connected to the container means and having an outlet, a pump having an inlet connected to the outlet of the first supply line and having an outlet, said pump being capable of feeding the liquid therethrough at a uniform rate greater than the combined needs of said devices, a second supply line connected to the outlet of said pump and communicating with a plurality of outlets individually connected to said liquid dispensing devices, valve means for individually establishing and shutting off the flow of liquid to said devices, a bypass line having an inlet connected to the outlet of said pump and an outlet communicating with said container means to provide a fluid flow path from the pump outlet to the container means in bypass relation to said devices, and control means comprising a closed liquid pressurizing and regulating flow control tank serially connected for one-way flow of the entire output of said bypass line via said tank to said container means, said tank comprising a hollow container having a first wall defining a liquid receiving chamber, a second wall defining a gas receiving chamber, an inlet in said first wall connected via said bypass line to the outlet of said pump, an outlet in said first wall connected to said container means via said outlet of said bypass line, said tank outlet being separate from said tank inlet but in relatively closely spaced adjacent relationship with said tank inlet, a diaphragm made of flexible gas and water impermeable material and secured about its periphery in sealed relation to the interior of said tank intermediate said first and second walls so as to provide a movable barrier between said chambers, said diaphragm being made to conform closely to the shape of said first wall such that in the untensioned state of said diaphragm material said diaphragm engages said first wall and extends therealong in conformity therewith in the empty condition of said liquid receiving chamber, said diaphragm thereby sealing said tank inlet and said tank outlet in the untensioned state of said diaphragm, a one-way gas valve in said second wall adapted for coupling with a gas charging conduit for filling said gas chamber with a compressible gas to a pressure which has an initial predetermined value when the liquid receiving chamber is empty and unpressurized, said diaphragm being movable by flexure thereof to inversely vary the volumes of said chambers in response to liquid pressure variations in excess of the pressure prevailing in said gas receiving chamber when said liquid chamber is empty, said relatively closely spaced relationship of said tank inlet and outlet being such that said diaphragm is urged towards said inlet and outlet as the liquid pressure falls below said prevailing pressure so as to maintain a uniform delivery pressure to said devices.

16. A flow control tank adapted to be serially connected for one-way flow of liquid from a source of pressurized liquid via said tank to liquid distribution system, said tank comprising a hollow container having (1) a first wall defining a liquid receiving chamber, (2) a second wall defining a gas receiving chamber, (3) a liquid inlet in said first wall adapted to be connected to said source, (4) a liquid outlet in said first wall adapted to be connected to the liquid distribution system, said outlet being separate from said inlet but in relatively closely spaced adjacent relationship with said inlet, (5) a diaphragm made of flexible gas and liquid impermeable material and secured about its periphery in sealed relation to the interior of said tank intermediate said first and second walls so as to provide a movable barrier between said chambers, said diaphragm being made to conform closely to the shape of said first wall such that in the untensioned state of said diaphragm material said diaphragm engages said first wall and extends therealong in conformity therewith in the empty condition of said liquid receiving chamber, said diaphragm thereby sealing said inlet and said outlet in the untensioned state of said diaphragm, (6) a one-way gas valve in said second wall adapted for coupling with a gas charging conduit for filling said gas chamber with a compressible gas to a pressure which has an initial predetermined value when the liquid receiving chamber is empty and unpressurized, (7) said diaphragm being movable by flexure thereof to inversely vary the volumes of said chambers in response to liquid pressure variations in excess of the pressure revailing in said gas receiving chamber when said liquid chamber is empty, said relatively closely spaced relationship of said inlet and outlet being such that said diaphragm seals against both said inlet and outlet substantially simultaneously as the liquid pressure falls below said prevailing pressure, including when said gas charge is completly lost and said prevailing pressure is atmospheric, so as to prevent liquid remaining in said inlet from flowing backward via the inlet into said source.

17. In a well system, the combination comprising a pump having an inlet and an outlet, a combined pressure regulating valve and pressure tank, said combined pressure regulating valve and pressure tank comprising a hollow container having a flexible diaphragm dividing said container into a water receiving chamber and a gas receiving chamber, said gas receiving chamber being adapted to be charged with a compressible gas, said water receiving chamber having an inlet connected to the outlet of the pump and an outlet, said diaphragm normally sealing the inlet and outlet to said chamber in the absence of pressure from the pump sufficient to move the diaphragm away from the inlet and outlet, said gas receiving chamber of said tank being charged to a control pressure sufficient to throttle the output flow from said pump to a flow rate less than the yield rate of the water well of said system when the level of the water in the well is at a predetermined minimum level condition, said diaphragm being forced by the pressurized gas in said gas receiving chamber into close proximity to said inlet and outlet of said tank to thereby restrict the cross-sectional flow area between said tank inlet and outlet via said water receiving chamber such that the flow of the pump matches the flow of the minimum well yield to thereby match the yield of the well to the capacity of said pump and thus maintain the water level in the well at or above said predetermined minimal level, whereby said combined pressure regulator valve and pressure tank functions to insure that the flow from the outlet is substantially at or above said control pressure and that when the pressure falls therebelow the diaphragm seals against said inlet and the outlet and maintains water in the outlet of the pump sufficient to maintain a prime on the pump and prevent the pump from running dry.

18. The combination set forth in claim 5 and further including in combination therewith a second water storage tank in fluid communication with said water distribution system downstream of said first-mentioned tank, said second tank having a water receiving and pressurizing chamber and a gas receiving headspace chamber precharged to a first predetermined pressure in the empty condition of said water chamber when the water pressure therein is at or below said first predetermined water pressure, said second tank being operable to receive water flowing from said water pump via said first tank to fill said second tank water receiving chamber until the gas in said gas chamber is compressed to a higher pressure corresponding to said second predetermined water pressure, said first tank being charged to a control pressure sufficient to throttle the output flow from said pump to a flow rate less than the yield rate of the water well of said system when the level of the water in the well is at a predetermined minimum level condition, said diaphragm of said first tank being forced by the pressurized gas in said gas receiving chamber of said first tank into close juxtaposition to said inlet and outlet thereof to thereby restrict the cross-sectional flow area between said first tank inlet and outlet via said water receiving chamber thereof to thereby restrict the flow of the pump to match the flow of the minimum well yield and thus match the yield of the well to the capacity of said pump, thereby maintaining the water level in the well at or above said predetermined minimal level.

19. The combination set forth in claim 18 wherein said control pressure in said first tank has a minimum value greater than said second predetermined water pressure.

20. The combination set forth in claim 19 wherein the maximum volume of the water receiving chamber of said second tank is many times the maximum volume of the water receiving chamber of said first tank.

* * * * *